US008303316B2

(12) United States Patent
Scheibelhut et al.

(10) Patent No.: US 8,303,316 B2
(45) Date of Patent: Nov. 6, 2012

(54) CONTACT FIXTURE

(75) Inventors: Peter Scheibelhut, Paderborn (DE); Andreas Hostmann, Paderborn (DE)

(73) Assignee: dSPACE digital signal processing and control engineering GmbH, Paderborn (DE)

( * ) Notice: Subject to any disclaimer, the term of this patent is extended or adjusted under 35 U.S.C. 154(b) by 31 days.

(21) Appl. No.: 12/967,215

(22) Filed: Dec. 14, 2010

(65) Prior Publication Data

US 2011/0151691 A1 Jun. 23, 2011

(30) Foreign Application Priority Data

Dec. 22, 2009 (DE) ..... 10 2009 060 423

(51) Int. Cl.
*H01R 12/51* (2011.01)
*H01R 12/00* (2006.01)

(52) U.S. Cl. ..... 439/81

(58) Field of Classification Search ..... 439/76.1, 439/81

See application file for complete search history.

(56) References Cited

U.S. PATENT DOCUMENTS

| | | | | |
|---|---|---|---|---|
| 4,363,530 | A | 12/1982 | Verhoeven | |
| 4,688,875 | A * | 8/1987 | O'Connor | 439/676 |
| 4,878,851 | A * | 11/1989 | Mullen, III | 439/83 |
| 5,199,879 | A * | 4/1993 | Kohn et al. | 439/63 |
| 5,411,399 | A * | 5/1995 | Okuyama et al. | 439/67 |
| 5,522,730 | A | 6/1996 | Soes et al. | |
| 5,634,810 | A | 6/1997 | Niitsu et al. | |
| 5,820,390 | A | 10/1998 | Takamoto et al. | |
| 6,799,980 | B2 * | 10/2004 | Bloomfield et al. | 439/92 |
| 7,083,431 | B1 * | 8/2006 | Darr et al. | 439/75 |
| 7,621,756 | B2 * | 11/2009 | Dittmann | 439/66 |
| 2002/0142630 | A1 * | 10/2002 | Molus et al. | 439/76.1 |
| 2003/0040202 | A1 * | 2/2003 | Norris et al. | 439/76.1 |
| 2007/0264849 | A1 * | 11/2007 | Steckler et al. | 439/82 |
| 2010/0279536 | A1 * | 11/2010 | Paulus | 439/357 |
| 2011/0151691 | A1 * | 6/2011 | Scheibelhut et al. | 439/81 |

FOREIGN PATENT DOCUMENTS

| | | | |
|---|---|---|---|
| DE | 7817708 | U1 | 11/1978 |
| DE | 19604431 | C1 | 5/1997 |

OTHER PUBLICATIONS

German Search Report dated Nov. 10, 2010 (with machine translation).

"Poly Rack" Tech Group Newsletter.

* cited by examiner

*Primary Examiner* — James Harvey

(74) *Attorney, Agent, or Firm* — Orrick Herrington & Sutcliffe, LLP

(57) ABSTRACT

The patent deals with a contact fixture for a PCB with one first plug-in connector and one second plug-in connector, whereby the first plug-in connector has a number of first contact elements, the second plug-in connector has a number of second contact elements, the first plug-in connector is arranged on the first side of the PCB, the second plug-in connector is arranged on the second side of the PCB opposite to the first side, the first contact element and/or the second contact element is/are designed as a connector to establish a detachable electrically conductive connection with at least the second contact element or the first contact element, and the first contact element and the second contact element are connected through an opening in the PCB.

13 Claims, 7 Drawing Sheets

CONTACT FIXTURE

CROSS REFERENCE TO RELATED APPLICATIONS

Figure 1:
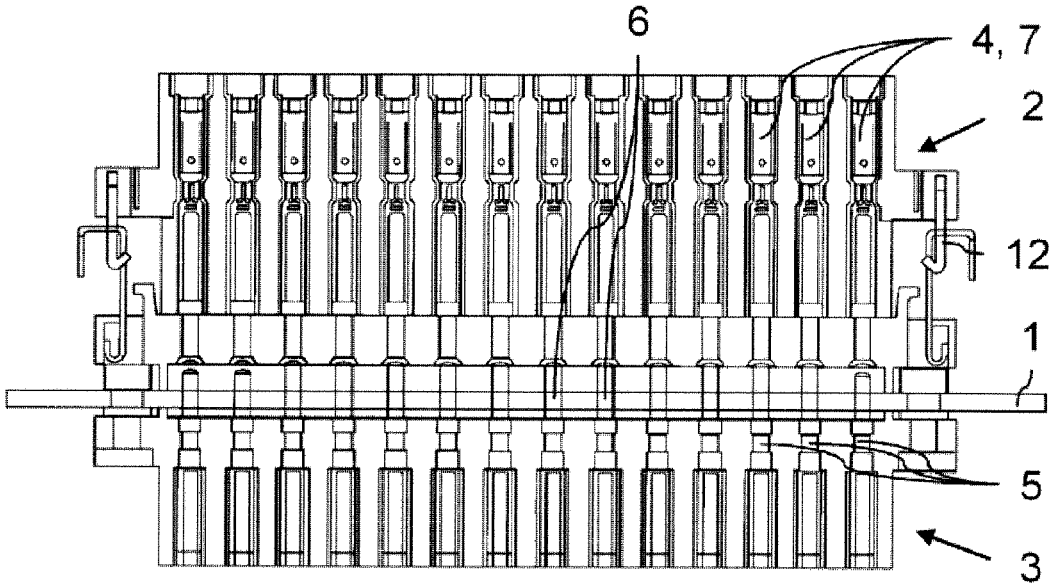

The subject application claims priority to German patent application No. DE 10 2009 060 423.5 filed Dec. 22, 2009.

FIELD OF THE INVENTION

This invention relates to a contact fixture for a printed circuit board (PCB), with one first plug-in connector and one second plug-in connector, as well as a contact arrangement including the contact fixture.

BRIEF DESCRIPTION OF THE INVENTION

In accordance with one aspect of the invention, a contact fixture for a PCB with a first plug-in connector and a second plug-in connector, whereby the first plug-in connector has a number of first contact elements, the second plug-in connector has a number of second contact elements, the first plug-in connector is arranged on a first side of the PCB, the second plug-in connector is arranged on a second side of the PCB opposite to the first side, the first contact element and/or the second contact element comprises a connector that can establish a detachable electrically conductive connection with at least the second contact element or the first contact element, and the first contact element and the second contact element are connected through an opening in the PCB.

In accordance with another aspect of the invention, a contact fixture is specified for a PCB, which, on the one hand, as a result of the configuration of the first contact element and/or the second contact element as a connector, facilitates a simple way of arranging the contact fixture on the PCB, and, on the other hand, facilitates a space-conserving arrangement of the first plug-in connector and the second plug-in connector on the PCB. Moreover, in accordance with another aspect of the invention, it is foreseen that at least one contact element may comprise a connector, so that the first plug-in connector and the second plug-in connector can be coupled to one another in a simple manner on the PCB such that the first plug-in connector may be arranged on a first side of the PCB and the second plug-in connector may be arranged on a second side of the PCB, whereby, using the connector, a simple electrically conductive connection between the first contact element and the second contact element, i.e. between the first plug-in connector and the second plug-in connector can be established, on the one hand, and is detachable, on the other hand.

Furthermore, in accordance with another aspect of the invention, the first contact element and/or the second contact element can provide an electrically conductive connection with the PCB or one track of the PCB, so that an electrically conductive connection can be established between the first plug-in connector, the PCB, and the second plug-in connector in a space-conserving manner. In accordance with another aspect of the invention, the contact fixture facilitates the electrically conductive connection, for example, of other modules fitted with plug-in connectors, which can be connected in a simple manner with the first plug-in connector and/or with the second plug-in connector of the contact fixture proposed by the patent. Moreover, in accordance with a further aspect of the invention, the first contact elements and/or the second contact elements may comprise a connector to establish an electrically conductive connection of a detachable electrical connection with at least one respective second contact element or with at least one respective first contact element, and the first contact elements and the second contact elements may be coupled through a respective opening in the PCB.

The first plug-in connector and/or the second plug-in connector can be configured as any plug-in connectors known from the prior art, whereby the technician can provide a DIN plug-in connector, for example, in accordance with the DIN standard 41612. Such plug-in connectors, in many cases, have a plug-in connector body made of a fiber-glass reinforced thermoplastic molded material, whereby the plug-in connector body, on the one hand, insulates the contact elements from one another electrically, and, on the other hand, fixes the contact elements opposite to the plug-in connector. The contact elements can, for example, be configured as contact pins, and can be arranged in a grid (raster) of 5 mm, 2.54 mm, 2.5 mm or 2 mm in the plug-in connector.

Similarly, the PCB may comprise a multi-layer PCB, that is, it has electrically conductive tracks in multiple layers. The first side of the PCB and the second side of the PCB may correspond to the two flat sides of the PCB. Moreover, the opening in the PCB may accommodate the contact element generally evenly or flush with it, that is, for example, the diameter of an opening configured as a round borehole is only marginally greater than or equal to the diameter of a contact element having a round or almost round cross-section. In accordance with another aspect of the invention, the first contact element and/or the second contact element in the region of the PCB may be arranged generally vertically to the surface of the PCB.

Basically, the connector may be configured in any desired manner to establish the detachable electrically conductive connection between the first contact element and the second contact element. In accordance with another aspect of the invention, the connector may be configured to establish a connection that is form-fit, press-fit and firmly bonded. In addition, the connector may comprise one of the items from the group consisting of screw connections, plug-in connections, telescopic connections, press-fit connections, crimp-type connections, snap-fit connections, soldered connections, welded connections and/or bonded connections.

In accordance with another aspect of the invention, the electrically conductive connection between the first contact element and the second contact element, for example, may comprise a form-fit (or interlocking) screw connection, snap-fit connection, groove-and-tongue connection and/or a key and notch connection. Similarly, a press-fit connection may be provided, that is, the connection may be configured such that static friction between the first contact element and the second contact element can prevent mutual movement of the first contact element in relation to the second contact element.

In accordance with another aspect of the invention, it is foreseen that the connector comprises as a sleeve-shaped and/or telescopic type to guide at least one contact element into the connector. With the help of such a design, the first contact element and the second contact element can be coupled to one another very easily.

Moreover, sleeve-shaped and/or telescopic type connectors may be provided such that two such contact elements can be guided into the connector that is designed in such a manner. As a result, for example, other "male" plug-in connectors can be connected to "female" connectors designed in this manner.

In accordance with another aspect of the invention, the sleeve-shaped and/or telescopic type connector means has a limit stop to limit the penetration depth of the contact element into the connector. Such a limit stop, for example, can comprise a "taper" in the sleeve-shaped and/or telescope type connector, or as any other common limit stop device from the prior art and known to the person skilled in the art, and can be formed, for example, as a notch or an edge of the connector. Similarly, the first plug-in connector can comprise as a limit stop, for example, as a tapered unit to limit the penetration depth of the contact element in the connector.

Moreover, in accordance with another aspect of the invention, the sleeve-shaped and/or telescopic type of connector has a fixing mechanism to fix the contact element in the connector. The fixing mechanism may comprise a spring element. Basically, the fixing mechanism may comprise any fixing mechanism known from the prior art, which fixes the contact element in the connector.

In accordance with another aspect of the invention, it is foreseen that the first contact element may comprise a connector, the number of second contact elements being larger than that of the first contact elements, and all second contact elements may be drawn through a respective opening in the PCB. In other words, in accordance with this aspect of the invention, it is foreseen that a part of the second contact elements may be connected in an electrically conductive manner with the first contact element designed as a connector, while the remaining part of the second contact elements may be drawn through respective openings in the PCB, but, are not connected with the first contact elements. In this manner, the remaining part of the second set of contact elements, for example, may be connected to fix the second plug-in connector to the PCB, and/or the remaining set of second contact elements may be connected in an electrically conductive manner to the PCB or a track of the PCB.

In accordance with another aspect of the invention, the connector may be disposed within the first plug-in connector, within the second plug-in connector or between the first plug-in connector and the second plug-in connector.

In principle, the first plug-in connector and the second plug-in connector respectively can have any desired number of first contact elements or second contact elements. In accordance with another aspect of the invention, another contact element and/or another connector may be arranged between the first contact element and the second contact element, and that the extra contact element and/or the extra connector is coupled to the first contact element and the second contact element in an electrically conductive manner. In other words, the electrical connection between the first plug-in connector and the second plug-in connector may have at least one first contact element, one second contact element and at least one other contact element, whereby the first contact element, the second contact element and/or the extra contact element is designed as a connector.

In accordance with another aspect of the invention, the first plug-in connector and/or the second plug-in connector may have at least two components and the first contact element or the second contact element can be fixed in the first plug-in connector or in the second plug-in connector by joining the components. Thus, according to this aspect of the invention, the first plug-in connector and/or the second plug-in connector have a "sandwich design", with the help of which, the contact element can be fixed in the plug-in connector using, for example, "Snap-in" seals, by joining and connecting the sandwich construction.

In accordance with another aspect of the invention, a contact arrangement, including the contact fixture, and a PCB, whereby the PCB has at least one electrically conductive layer and the first contact element and/or the second contact element is connected with the electrically conductive layer in an electrically conductive manner.

The contact arrangement facilitates a simple and space-conserving electrically conductive contact of the first plug-in connector and the second plug-in connector with the PCB or with a conductive layer of the PCB. The opening of the PCB may comprise an interlayer connection to establish the electrically conductive connection between the conductive layer and the first plug-in connector and/or the second plug-in connector. The electrically conductive layer may comprise a track. In this context, the first contact element and/or the second contact element may be fixed to the PCB.

The first contact element and/or the second contact element may be fixed to the PCB mechanically and/or in an electrically conductive manner. The fixture of the contact element to the PCB thereby, may be configured by a mechanism known to the person skilled in the art, for example, by one of the connections presented above, such as a soldered connection. Similarly, in this context, the first plug-in connector and/or the second plug-in connector may have a device for attaching the first plug-in connector or the second plug-in connector to the PCB. Such a device can, for example, comprise a screw connection.

BRIEF DESCRIPTION OF THE DRAWINGS AND FIGURES

The invention is explained in detail with reference to the drawing enclosed and on the basis of the preferred embodiments in the following.

Figure 2:
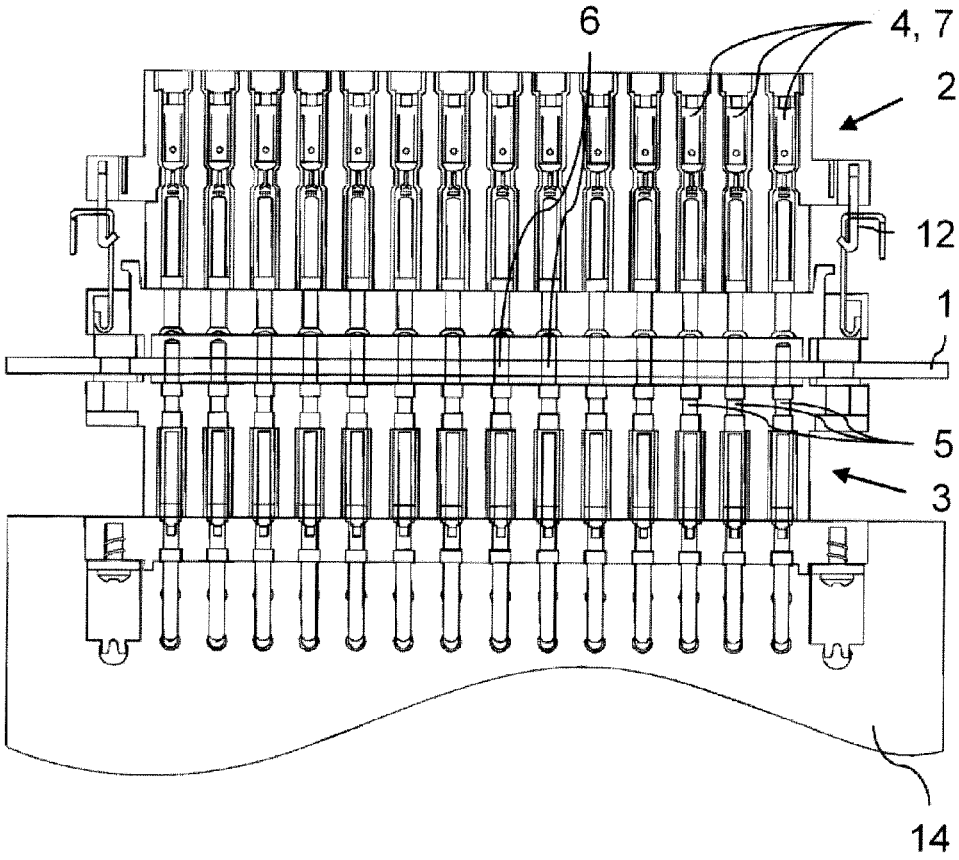
Figure 3:
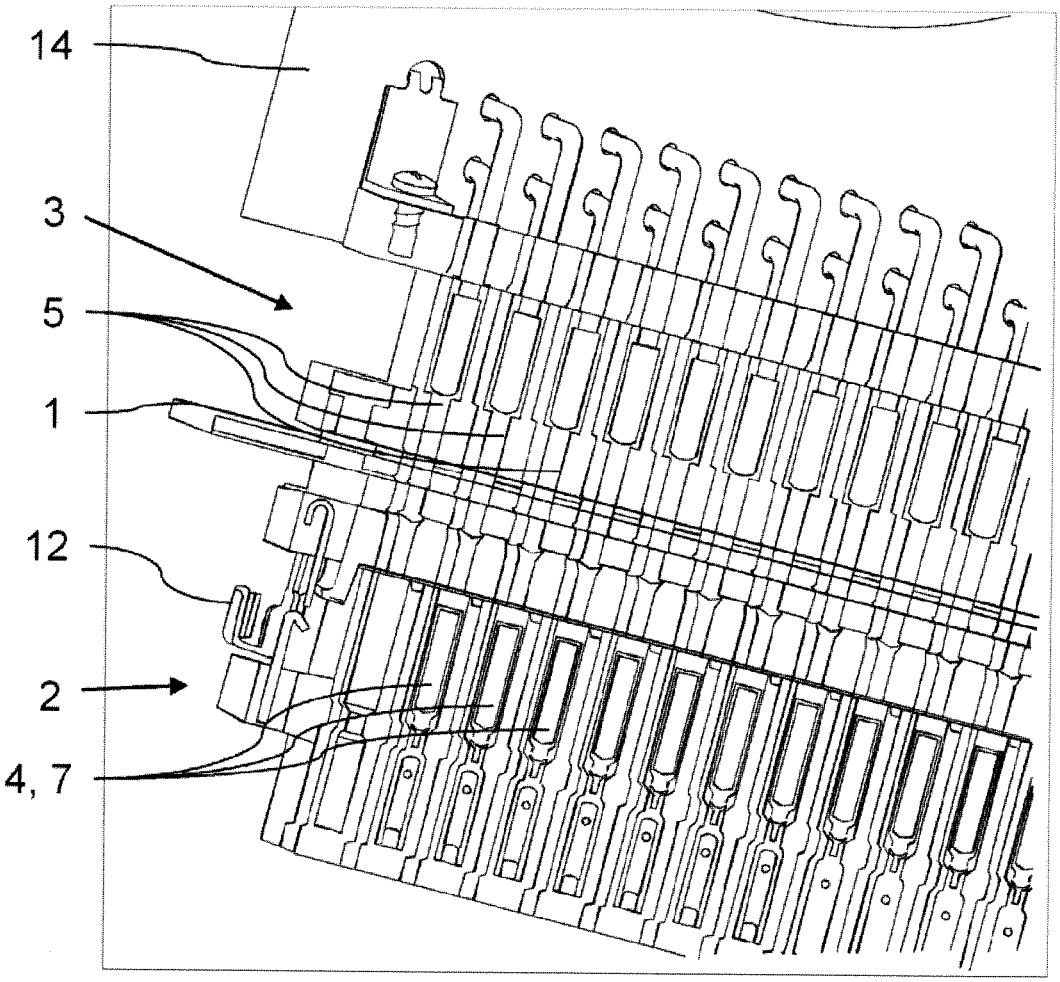
Figure 4:
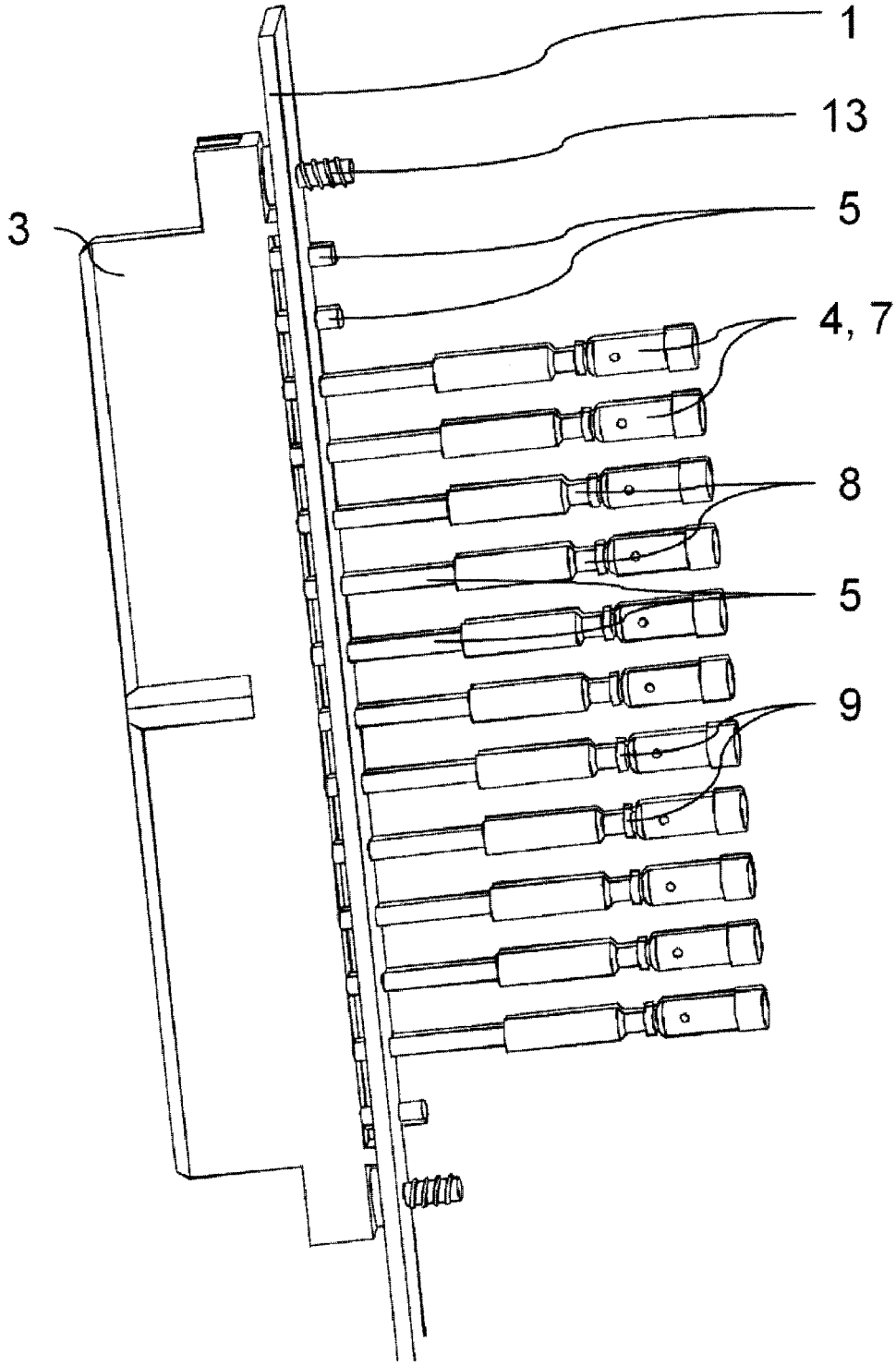
Figure 5:
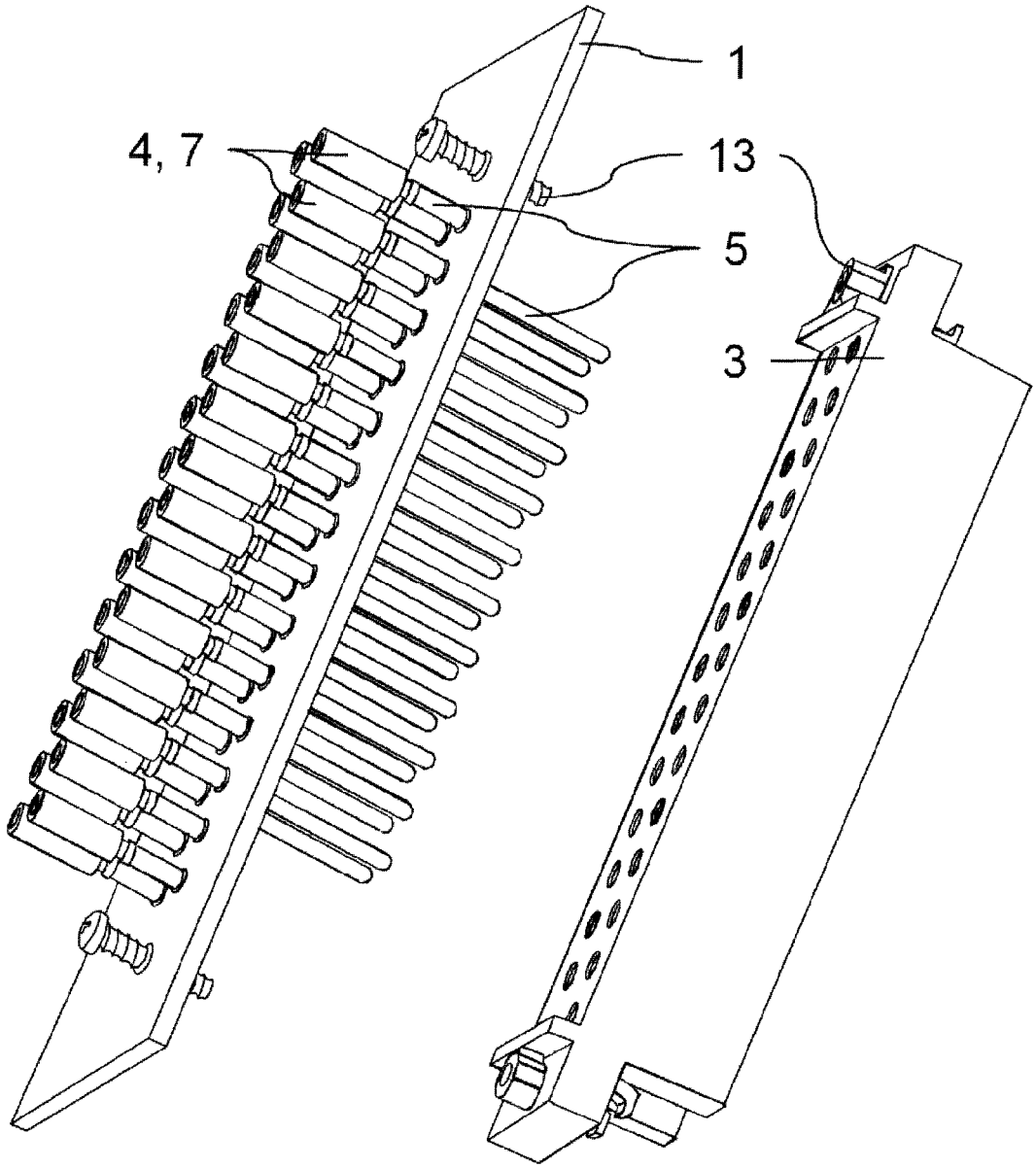
Figure 6:
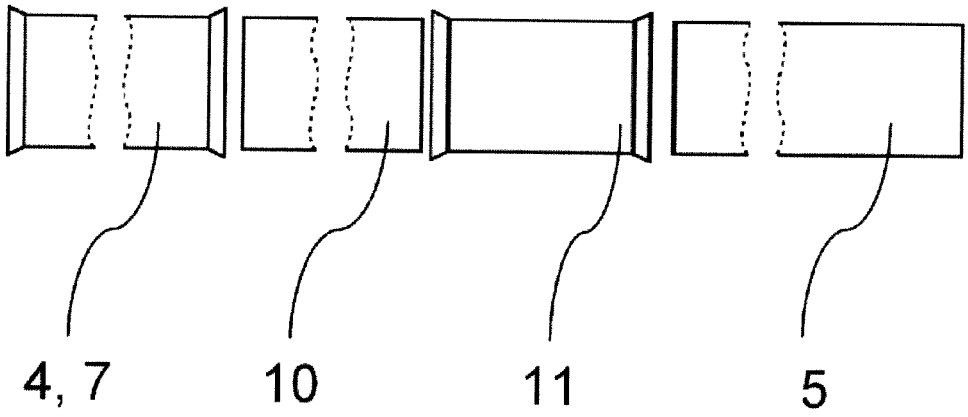
Figure 7:
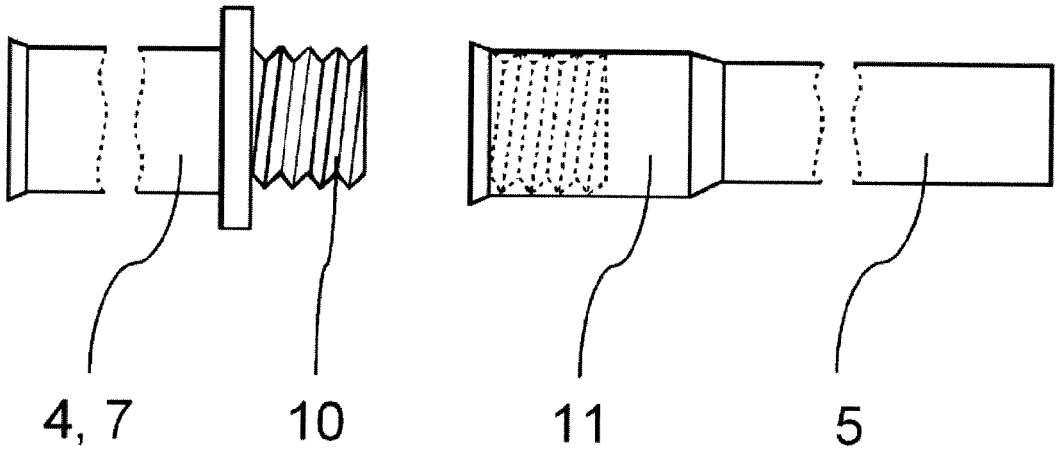

FIG. 1, is a contact fixture in accordance with one aspect of the invention presented in the form of a schematic sectional view, FIG. 2, is a contact fixture in accordance with another aspect of the invention represented with the help of a schematic sectional view, FIG. 3, is a contact fixture in accordance with another aspect of the invention presented in the form of a perspective view, FIG. 4, is a part of the contact fixture in accordance with a further another aspect of the invention presented in the form of a perspective view, FIG. 5, is a part of the contact fixture in accordance another aspect of the invention presented in the form of a perspective view, FIG. 6, is a contact element of the contact fixture in accordance with another aspect of the invention presented in the form of a schematic view, and FIG. 7, is a contact element of the contact fixture in accordance with another aspect of the invention presented in the form of a schematic view.

DESCRIPTION OF THE EMBODIMENTS

FIG. 1 illustrates a contact fixture for a PCB 1 having one first plug-in connector 2 and one second plug-in connector 3.

As is evident from FIG. 1, the first plug-in connector 2 has eleven first contact elements 4, while the second plug-in connector has fourteen second contact elements 5. The first plug-in connector 2 is arranged on the first side of the PCB 1, while the second plug-in connector 3 is arranged on the second side of the PCB 1.

The first plug-in connector 2 and the second plug-in connector 3 have been designed as DIN plug-in connectors in accordance with the DIN standard 41612, and have a plug-in connector body made of fiber-glass reinforced thermoplastic molded material, whereby the plug-in connector body insulates the contact elements 4, 5 electrically from one another on the one hand, and on the other hand, fixes the contact elements 4, 5 across from the respective plug-in connectors 2, 3. The contact elements, 4, 5 are designed as contact pins, and can be arranged in a grid (raster) of 5 mm, 2.54 mm, 2.5 mm or 2 mm in the respective plug-in connectors 2, 3.

While the second contact elements 5 are drawn through an opening 6, for example, a through borehole of PCB 1, the first contact elements 4 are designed as the connector 7 to establish an electrically conductive connection with the second contact elements 5. Moreover, the first contact elements 4 or the second contact elements 5 are connected in the region of the opening 6 in an electrically conductive manner with a conductive layer of the PCB 1, for example, a track of the PCB 1 that is not illustrated.

The connectors 7 are, moreover, designed to be sleeve-shaped or of telescopic type, as is evident from FIG. 4, or sleeve-shaped, as illustrated in FIG. 5, to guide or establish a form-fit connection with at least one contact element 4, 5. Similarly, in accordance with another aspect of the invention, the connection can be designed to be of press-fit or firmly bonded type.

By "placing" the first plug-in connector 2 and the second plug-in connector 3 on the first side of the PCB 1, or on the second side of the PCB 1, with the help of the connector 7, on the one hand, an electrically conductive connection can be established between the first plug-in connector 2 and the second plug-in connector 3 or between the respective first contact elements 4 of the first plug-in connector 2 and the respective second contact elements 5 of the second plug-in connector 3, as well as establishing an electrically conductive connection between the PCB 1 or a track of the PCB 1 and the first plug-in connector 2 and/or the second plug-in connector 3 or the respective first contact element 4 of the first plug-in connector 2 and/or the respective second contact element 5 of the second plug-in connector 3.

The telescopic type of connector 7, as evident from FIG. 4, has a limit stop 8 to limit the penetration depth of the contact elements 4, 5 into the connector 7. In the present case, the limit stop 8 has been designed as tapering of the sleeve-shaped and telescopic type of the connector 7. Similarly, the first plug-in connector 2 can be designed as a limit stop 8, for example, as a tapered unit to limit the penetration depth of the contact element 4, 5 in the connector 7. In another example of the embodiment of the limit stop 8, this can be at least one stopper edge at or within the first plug-in connector 2, whereby the stopper edge(s) is/are foreseen and provided in such a manner that it/they lie(s) generally evenly or flush with the PCB 1.

Moreover, the fastener or the fixing element 7 has a fastener 9 to fix the contact element 4, 5 in the connector 7, whereby the fastener 9 comprises a spring element.

As is evident from FIG. 1, 2 or 4, the number of second contact elements 5 is larger than that of the first contact elements 4, whereby all second contact elements 5 are drawn through a respective opening 6 of the PCB 1. Using the second contact elements that are not connected with the first contact elements 4, an improved fastener of the second plug-in connector 3 to the PCB 1 is achieved. Similarly, the second contact elements 5 not connected with the first contact elements 4 can be connected in an electrically conductive manner with the tracks of the PCB 1.

The connection established by the connector 7 can, furthermore, be designed as a screw connection, illustrated in FIG. 7, as a plug-in connection, as a telescopic connection, illustrated in FIG. 6, press-fit connection, crimped connection, soldered connection, welded connection and/or bonded connection.

In accordance with another aspect of the invention, as illustrated in FIGS. 6 and 7, there is an extra contact element 10 and an extra connector 11 arranged between the first contact element 4 and the second contact element 5, and the extra contact element 10 and the extra connector 11 are connected with the first contact element 4 or with the second contact element 5 in an electrically conductive manner. As illustrated in FIG. 7, the extra contact element 10 is designed with an external thread and the extra connector 11 is designed with an internal thread. The extra contact element 10 and the extra connector 11, form an electrically conductive connection when they are plugged or screwed together.

The first plug-in connector 2 and/or the second plug-in connector 3 have at least two components, whereby the first contact element 4 or the second contact element 5 can be fixed by joining them to the first plug-in connector 2 or the second plug-in connector 3. The components, for example, can be fixed or connected with one another with the help of "Snap-in" seals 12, as illustrated in FIG. 1.

In addition, the first plug-in connector 2 and/or the second plug-in connector 3 have a device 13 to fix the first plug-in connector 2 or the second plug-in connector 3 to the PCB 1, which has been designed as a screw in the present example.

The first plug-in connector 2 and/or the second plug-in connector 3 can be connected in an electrically conductive manner with the module racks 14, as illustrated in FIGS. 2 and 3. Such module racks 14 can, for example, also have electrical components like the PCB 1.

As a result, a contact fixture for a PCB 1 is obtained, by which electrical signals can be transferred in a simple manner via the plug-in connectors 2, 3 from the first side of the PCB 1 to the second side of the PCB and/or to the PCB 1.

The invention claimed is:

1. A contact fixture for a PCB with a first plug-in connector and a second plug-in connector, whereby the first plug-in connector has a number of first contact elements, the second plug-in connector has a number of second contact elements, the first plug-in connector is arranged on a first side of the PCB, the second plug-in connector is arranged on a second side of the PCB opposite to the first side, the first contact element and/or the second contact element comprising a connector to establish a detachable electrically conductive connection with at least the second contact element or the first contact element, the connector being generally sleeve-shaped to guide at least one contact element into the connector, and the first contact element and the second contact element being connected through an opening in the PCB.

2. A contact fixture according to claim 1, whereby the connector provides a form-fit, press-fit and/or bonded connection.

3. A contact fixture according to claim 1, whereby the connector comprises a connection from the group consisting of screw connection, plug-in connection, telescopic connection, press-fit connection, crimp-type connection, snap-fit connection, soldered connection, welded connection and/or bonded connection.

4. A contact arrangement, comprising the contact fixture according to claim 1 and a PCB wherein the PCB has at least one electrically conductive layer and the first contact element and/or the second contact element is connected with the electrically conductive layer in an electrically conductive manner.

5. A contact fixture according to claim 1, whereby the sleeve-shaped connector has a limit stop to limit the penetration depth of the contact element into the connector.

6. A contact fixture according to claim 1, whereby the sleeve-shaped connector has a fastener to fix the contact element into the connector.

7. A contact fixture according to claim 6, whereby the fastener comprises a spring element.

8. A contact fixture according to claim 1, wherein the first contact element comprises the connector, the number of second contact elements being larger than that of the first contact elements, and all second contact elements being drawn through a respective opening in the PCB.

9. A contact fixture according to claim 1, wherein the connector is generally disposed within the first plug-in connector generally disposed within the second plug-in connector or basically disposed between the first plug-in connector and the second plug-in connector.

10. A contact fixture according to claim 1, wherein an extra contact element and/or another connector is arranged between the first contact element and the second contact element, and that the extra contact element and/or the extra connector is connected to the first contact element and the second contact element in an electrically conductive manner.

11. A contact fixture according to claim 1, wherein the first plug-in connector and/or the second plug-in connector has at least two components, and the first contact element or the second contact element can be fixed in the first plug-in connector or in the second plug-in connector by joining the components.

12. A contact arrangement according to claim 4, wherein the first plug-in connector and/or the second plug-in connector has a fastener to fix the first plug-in connector or the second plug-in connector to the PCB.

13. A contact fixture according to claim 4, wherein the first contact element and/or the second contact element is fixed to the PCB.

* * * * *